United States Patent [19]

Oelsch

[11] Patent Number: 4,811,479

[45] Date of Patent: Mar. 14, 1989

[54] PROCESS FOR PRODUCING POTENTIOMETER RESISTANCES

[76] Inventor: Kurt Oelsch, Glockenstrasse 4, 1000 Berlin 37 (West), Fed. Rep. of Germany

[21] Appl. No.: 90,253

[22] PCT Filed: Nov. 7, 1986

[86] PCT No.: PCT/EP86/00640

§ 371 Date: Jul. 27, 1987

§ 102(e) Date: Jul. 27, 1987

[87] PCT Pub. No.: WO87/03417

PCT Pub. Date: Jun. 4, 1987

[30] Foreign Application Priority Data

Nov. 29, 1985 [DE] Fed. Rep. of Germany ..... 3542227

[51] Int. Cl.[4] ..... H01C 17/04

[52] U.S. Cl. ..... 29/618; 29/452; 338/141; 338/302

[58] Field of Search ..... 29/618, 452; 338/141, 338/147, 118, 162, 267, 218, 296, 297, 301, 302, 303

[56] References Cited

U.S. PATENT DOCUMENTS 1,767,716 6/1930 Stoekle ..... 29/618
2,221,235 11/1940 Ganci ..... 338/296
3,413,588 11/1968 Ferrell ..... 338/164

FOREIGN PATENT DOCUMENTS 732183 2/1943 Fed. Rep. of Germany ..... 29/618
1256527 12/1971 United Kingdom .

*Primary Examiner*—P. W. Echols
*Attorney, Agent, or Firm*—Lee & Smith

[57] ABSTRACT

A winding (12) is wound around a core (10) having a circular cross-section. The wound core (10) is then deformed by pressure between flat surfaces (14, 16) until a flat contact surface is created which allows the use of sliding brushes, for example.

1 Claim, 2 Drawing Sheets

PROCESS FOR PRODUCING POTENTIOMETER RESISTANCES

TECHNICAL FIELD

The invention relates to potentiometers and potentiometer resistors and a process for producing potentiometer resistors.

BACKGROUND ART

A potentiometer winding of this kind is known from FR-A No. 922 860, for example. With such potentiometer winding a cylindric or toric contact surface results. In order to ensure safe contact between potentiometer winding and slider with such a potentiometer winding, also when the slider moves quickly, expensive slider constructions are necessary (e.g. of the type of DE-A No. 3,413,741). Hereby the potentiometers become costly.

From GB-A No. 567 129 a process for producing wire resistance strain gauges is known. Wire resistance strain gauges comprise a wire which is applied to a carrier of paper and which is fixedly cemented by a special bonding agent on the surface of an element the extension of which is to be measured. When the examined element is extended, also the wire is extended and changes its electric resistance. This change of resistance is normally converted into an electric signal by a bridge circuit. In order to make the change of the resistance which can be achieved with a predetermined extension and predetermined length as large as possible the wire in such wire resistance strain gauges is arranged zigzag. GB-A No. 567 129 relates to a process for producing such wire resistance strain gauges as economically as possible. For that purpose, the wire is wound helically in one layer on a cylindric paper roll and is then flattened together with the paper roll.

This does not concern a potentiometer, not a solid carrier and not the problem of obtaining a flat contact surface for the slider in a potentiometer.

DISCLOSURE OF THE INVENTION

It is the object of the invention to provide a potentiometer winding at low costs, such that a contact surface is formed which allows always a close contact also with a slider having a less expensive construction, e.g. a brush slider.

According to the invention this object is achieved, with a potentiometer wherein a winding is wound around a solid core having a circular cross-section, the core with the winding wound thereon subsequently is deformed by pressure between flat surfaces, such that a flat contact surface is formed.

Thereby a flat contact surface is obtained with a brush type slider, that means a slider having a plurality of contact fingers which are arranged side by side and which are connected with each other, can engage throughout its whole width. Thereby a close contact is ensured, because always at least some of the contact fingers of the brush type slider are in close contact with the potentiometer resistor. The winding can be easily wound regularly around the core having a circular cross-section. By the deformation stretching of the wire is effected. The resistance of the potentiometer winding becomes higher. But this can be pre-calculated. It has been found that this deformation does not affect the remaining function of the potentiometer winding.

The process is described in further detail hereinafter with reference to the accompanying drawings.

BEST MODE OF CARRYING OUT THE INVENTION

Figure 1:
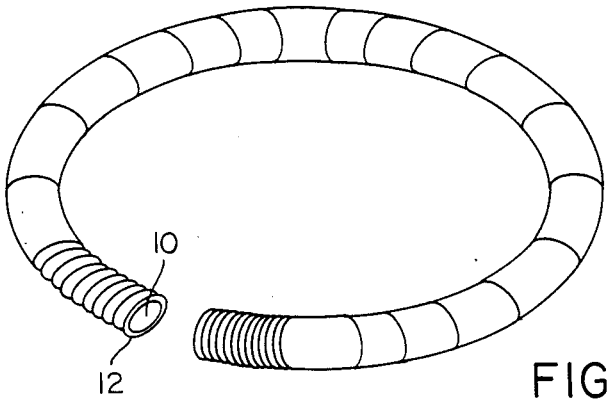
FIG. 1 is a schematic-perspective view of a potentiometer winding which is wound, in conventional manner, around a toric core having a circular cross-section.

In FIG. 1 numeral 10 designates a cut up toric solid core, which has a circular cross-section. A winding 12 is wound around that core 10 in conventional and therefore not illustrated manner.

Figure 2:
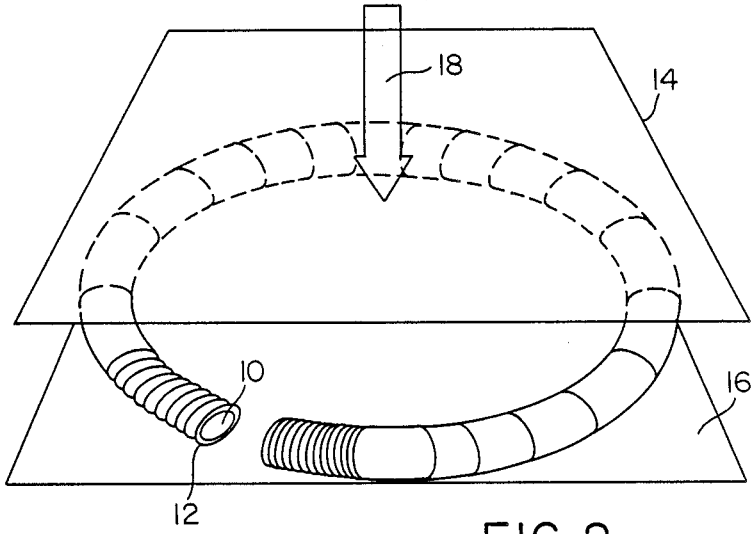
FIG. 2 schematically-perspectively illustrates the deformation process.

As illustrated in FIG. 2 the core 10 with the winding wound thereon is subsequently deformed together with the winding 12 by pressure between flat surfaces 14 and 16. That is indicated by the arrow 18.

Figure 3:
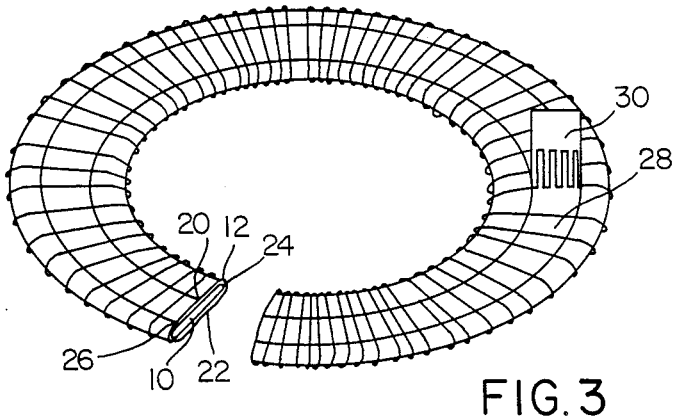
FIG. 3 is a schematic-perspective view of the deformed potentiometer winding.

Thereby a potentiometer resistor 32 as illustrated in FIG. 3 results: the cross-section of the core 10 is deformed such that it has two parallel, straight sides 20 and 22 which are connected by some curved portions 24 and 26. The winding is deformed accordingly. So the winding 12 forms an annular substantially flat contact surface 28 which is indicated by the dashed lines. This contact surface can be engaged by a conventional brush type slider 30 throughout its whole width, as illustrated in FIG. 3. Thereby also with such a slider close contact is continually ensured.

Figure 4:
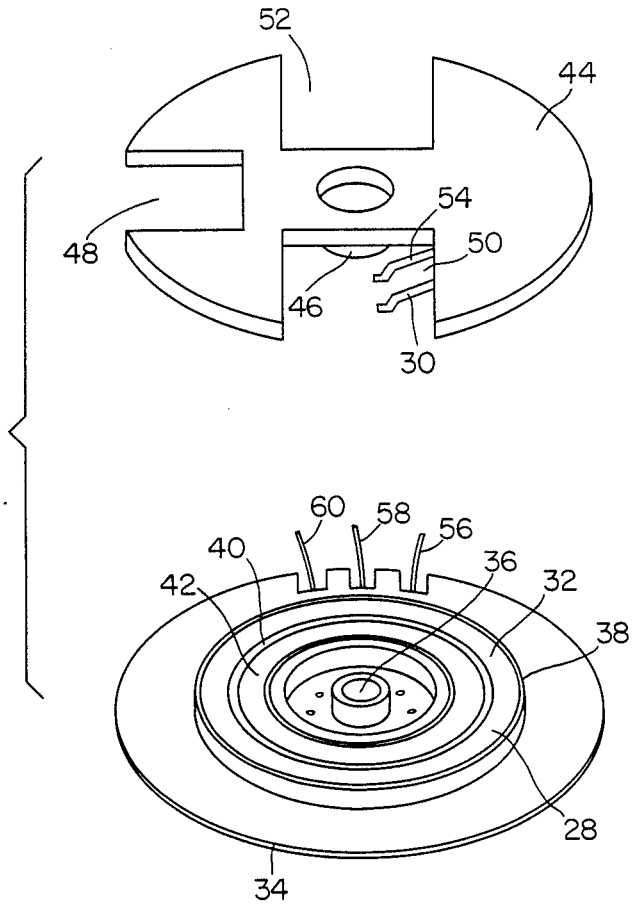
FIG. 4 is an explored perspective illustration of a potentiometer having a potentiometer winding produced according to FIG. 1 to 3.

FIG. 4 is an explored perspective illustration of a potentiometer which is constructed with a potentiometer resistor 32 according to FIG. 3.

A resistor holder 34 made of insulating plastics has a central aperture 36 and two concentric annular grooves 38 and 40. In the outer annular groove 38 the potentiometer resistor 32 of FIG. 3 having the flat contact surfaces 28 is arranged.

A slider carrier 44 is rotatably mounted by a hub element 46 in an annular groove which surrounds the central aperture. The slider carrier 44 is a plastics element of generally annular shape with three cutouts 48, 50, 52 at its rim angularly spaced by an angle of about 90 degrees. Two brush type sliders 30 (FIG. 3) and 54 are arranged at the edge of one of the cutouts, namely of cutout 52 and are electrically interconnected. As indicated in FIG. 3, brush type sliders are sliders which end in several fingers arranged side by side and electrically interconnected. These fingers engage the potentiometer resistor 32 or the slip ring 42. This embodiment ensures that always at least one finger is in contact with the potentiometer resistor 32 or the slip ring 42, respectively. In an assembled potentiometer the brush type slider 30 engages the flat contact surface 28 of the potentiometer resistor 32. The brush type slider 54 engages an also flat contact surface of the gilded slip ring 42.

Numerals 56, 58 and 60 designate the electric terminals of the potentiometer.

I claim:

1. A method of making potentiometer resistors having a winding of a selected value of electrical resistance, said winding being wound on a solid annular core of oblong cross section and forming opposite flat surfaces, of which one is to serve as contact surface for engagement by a slider, comprising the steps of providing a solid annular core having a circular cross section, winding on said core a wire winding, the value of the electrical resistance of which is smaller than said selected value, subsequently deforming said solid core with said winding thereon to said oblong cross section by compressing it between flat, parallel surfaces to produce said flat contact surfaces while stretching the wire to such an extent that the winding assumes said selected value of resistance.

* * * * *